US011352810B2

(12) United States Patent
Kagan

(10) Patent No.: US 11,352,810 B2
(45) Date of Patent: Jun. 7, 2022

(54) CABINET DOOR AND LOCKING SYSTEM

(71) Applicant: KETER PLASTIC LTD., Herzliya (IL)

(72) Inventor: Ishay Kagan, Zikhron Ya'akov (IL)

(73) Assignee: KETER PLASTIC LTD., Herzliya (IL)

( * ) Notice: Subject to any disclaimer, the term of this patent is extended or adjusted under 35 U.S.C. 154(b) by 0 days.

(21) Appl. No.: 16/628,147

(22) PCT Filed: Jul. 3, 2018

(86) PCT No.: PCT/IL2018/050717
§ 371 (c)(1),
(2) Date: Jan. 2, 2020

(87) PCT Pub. No.: WO2019/008575
PCT Pub. Date: Jan. 10, 2019

(65) Prior Publication Data

US 2020/0123804 A1 Apr. 23, 2020

(30) Foreign Application Priority Data

Jul. 6, 2017 (IL) ..... 253353

(51) Int. Cl.
*E06B 3/70* (2006.01)
*E05B 1/00* (2006.01)
*E05C 19/18* (2006.01)

(52) U.S. Cl.
CPC ..... *E05B 1/0015* (2013.01); *E05C 19/188* (2013.01); *E06B 3/70* (2013.01); *E05Y 2900/20* (2013.01); *E06B 2003/7049* (2013.01)

(58) Field of Classification Search
CPC ... A47B 47/00; A47B 47/047; A47B 47/0075; A47B 47/0091; E05B 1/0015; E05C 19/188; E06B 3/70
USPC ..... 312/294, 257.1, 262, 263, 348.6
See application file for complete search history.

(56) References Cited

U.S. PATENT DOCUMENTS

| | | | | | |
|---|---|---|---|---|---|
| 5,074,009 | A * | 12/1991 | Simonton | A47B 95/02 | 16/416 |
| 5,931,553 | A * | 8/1999 | Cohen | A47B 47/0075 | 312/263 |
| 5,975,660 | A * | 11/1999 | Tisbo | A47B 47/045 | 312/108 |
| 6,250,022 | B1 * | 6/2001 | Paz | E04B 1/34321 | 312/100 |
| 6,412,317 | B1 * | 7/2002 | Martin | E05B 9/08 | 312/348.6 |
| 6,678,920 | B2 * | 1/2004 | Parker | A47B 95/02 | 16/111.1 |
| 6,820,950 | B1 * | 11/2004 | Sun | A47B 47/042 | 312/108 |
| 2002/0125799 | A1 * | 9/2002 | Landsberger | A47B 87/02 | 312/209 |

FOREIGN PATENT DOCUMENTS

| | | | | |
|---|---|---|---|---|
| EP | 2741632 | * | 6/2014 | A47B 47/04 |
| WO | 2005/016072 | A2 | 2/2005 | |
| WO | 2013/020721 | A1 | 2/2013 | |

* cited by examiner

*Primary Examiner* — James O Hansen
(74) *Attorney, Agent, or Firm* — Vorys, Sater, Seymour and Pease LLP; William L. Klima

(57) ABSTRACT

Provided is a cabinet door-system and a locking mechanism therefore.

13 Claims, 21 Drawing Sheets

CABINET DOOR AND LOCKING SYSTEM

TECHNOLOGICAL FIELD

The present disclosure is directed to a cabinet door-system and a locking mechanism therefore.

BACKGROUND

Cabinets are often configured with two or more doors, e.g. at a side by side configuration (i.e. doors having their locking stiles neighboring one another), at a door-over-door configuration (e.g. with the bottom rail of one door extending over a top rail a second door), with various combinations (e.g. 2×2, wherein two top side-by-side doors extend over two bottom side-by-side doors), etc. At times it may be required to adjoin two doors, e.g. in a door-over-door configuration, whereby the two (or more) doors become united, to permit simultaneous opening/closing of the adjoined doors.

GENERAL DESCRIPTION

A first aspect of the present disclosure is directed to a cabinet comprising at least one door panel displaceable over an opening of the cabinet between an open position and a closed position, said door panel is configured with at least at one of a top rail and a bottom rail with an attachable locking member, and where the locking member is configured for locking with a locking member of a neighboring door panel or with a cabinet frame locking portion.

According to a particular configuration, a locking member is attached at a door panel rail of a first door panel and at a neighboring door panel rail of a second door panel, whereby the first panel and the second panel become integrated (or joined).

In another particular configuration, at a door-over-door orientation the locking member can be removed upon displacing the door panels into an at least partially open position, accordingly, the locking cannot be removed at the closed position of the doors.

According to another aspect, there is provided a door panel for a cabinet, said door panel being fully interchangeable, wherein the door panel is configured to serve as any one of a top door, a bottom door, an intermediate door, a left rail hinged door and a right rail hinged door, and wherein at least one of a top rail and a bottom rail of the door panel is configured for receiving a door reinforcing element, said door reinforcing element configured in turn for receiving a locking member engageable to a neighboring door.

According to a particular configuration, the door panel is configured for receiving a door reinforcing element at a locking stile of the door panel, said door reinforcing element comprises an integral locking eye, whereby in the absence of a locking member two neighboring doors are lockable one to the other through their respective integral locking eyes.

According to another configuration, a handle portion of the door panel is configured with a recessed groove for snapingly accommodating the locking member.

According to a further configuration, one of the locking member and the door panel can be configured with one or more protrusions, and the other of the locking member and the door panel can be configured with respective snap indentions, for snapping retention of the locking member with the door panel.

The door panel can be made of plastic material, configured with cavities for receiving one or more door reinforcing elements comprising of a top rail, a bottom rail, a locking stile and a hinged stile, and at least one of the door reinforcing elements is configured for receiving a locking eye.

According to another aspect of the disclosure there is provided a locking member (for use in conjunction with a cabinet described herein) configured for attaching to a door panel rail of a cabinet, the locking member being configured for locking with a locking member of a neighboring door panel or a cabinet frame locking portion.

According to a particular configuration, the locking member can be attached at a door panel rail of a first door panel and at a neighboring door panel rail of a second door panel, thereby integrating the first panel and the second panel to one another.

The terms integrated and integrating, alternatingly, as used herein are meant to denote that the first panel and the second panel become fixed to one another so as to form a unitary door panel, whereby the panels will simultaneously displace between the open position and the closed position.

According to yet another aspect of the disclosure there is an injection molded door panel configured for use in conjunction with a cabinet, said door panel being fully interchangeable, wherein a single door panel can serve as any one of a top door, a bottom door, an intermediate door, a left rail hinged door and a right rail hinged door, and wherein at least one of a top rail and a bottom rail of the door panel is configured for receiving a door reinforcing element, said door reinforcing element configured in turn for receiving a locking member.

Any one or more of the following features, designs and configurations can be applied to the aspects of the present disclosure, separately or in various combinations thereof:

- The locking member can be detachably attachable at one or more rail portions of a door panel; the locking member can be attached at any one or more of a top rail, a bottom rail or a locking stile of a door panel;
- Neighboring door panels articulated to one another by a locking member can be disposed at a side-by-side orientation, or at a door-over-door orientation;
- The locking member can engage two door-over-door panels to thereby integrate said door panels, and a locking member eye is configured for interaction in locking engagement with a neighboring locking member;
- Rail portions of articulated neighboring door panels can be disposed flush with one another, with said door panels extending coplanar;
- One or both of a top rail and a bottom rail of the door panel can be configured with a handle portion, for manipulating the door panel between the open position and the closed position;
- The handle portion can be configured with a recessed groove accommodating the locking member;
- The locking member can be slidingly displaceable within the recessed groove of the door panel;
- The locking member can be snapingly articulated within the recessed groove of the door panel;
- At a door-over-door orientation, the locking member can be removed upon displacing the door panels into an at least partially open position; accordingly, at the closed position of the doors the locking member articulating the two doors cannot be manipulated/removed;
- The door panel can be fully interchangeable, wherein a single door panel can serve as any one of a top door, a bottom door, an intermediate door, a left rail hinged door and a left rail hinged door;

The locking member can facilitate for articulating two or more door panels to one another, at a coplanar configuration; to thereby form an integrated, single door;

A portion of the locking member can project from a front surface of the door panel;

A door panel can be locked at the closed position by applying a pad lock through a locking eye portion of neighboring locking members;

The locking member can be configured with a gripping portion;

One of the locking member and the recessed groove of the door panel can be configured with one or more protrusions, and the other of the locking member and the recessed groove of the door panel can be configured with respective snap indentions, for snapping retention of the locking member within the recessed groove of the door panel;

The door panel can be a sliding door or a hinged door;

The doors can be made of a variety of materials. According to one example, the door panel can be made of plastic material, such as blow molded, injection molded, etc.;

According to a particular configuration, the doors are configured with cavities for receiving one or more door reinforcing elements comprising of a top rail, a bottom rail, a locking stile and a hinged stile, and wherein said at least one of the door reinforcing elements is configured for receiving a locking eye;

The locking member, according to one particular configuration, has a generally L-like shape, with a first leg portion and a second leg portion, the first leg portion configured for simultaneously arresting within a top door rail of a bottom door panel and within a bottom door rail of a top, neighboring door panel. According to some configurations, the second leg portion can be configured with a locking eye;

The door reinforcing element can be configured such that it comprises an integral locking eye, whereby at the absence of a locking member two neighboring doors can be locked to one another through their respective integral locking eyes The locking member can be attached near a rail stile of a door by a fastener mechanism extending through a portion of the door. Such a fastening mechanism can be, for example, a snap-type fitting, a bolt fastener, etc.

BRIEF DESCRIPTION OF THE DRAWINGS

In order to better understand the subject matter that is disclosed herein and to exemplify how it may be carried out in practice, embodiments will now be described, by way of non-limiting example only, with reference to the accompanying drawings, in which.

DETAILED DESCRIPTION OF EMBODIMENTS

Figure 1A:
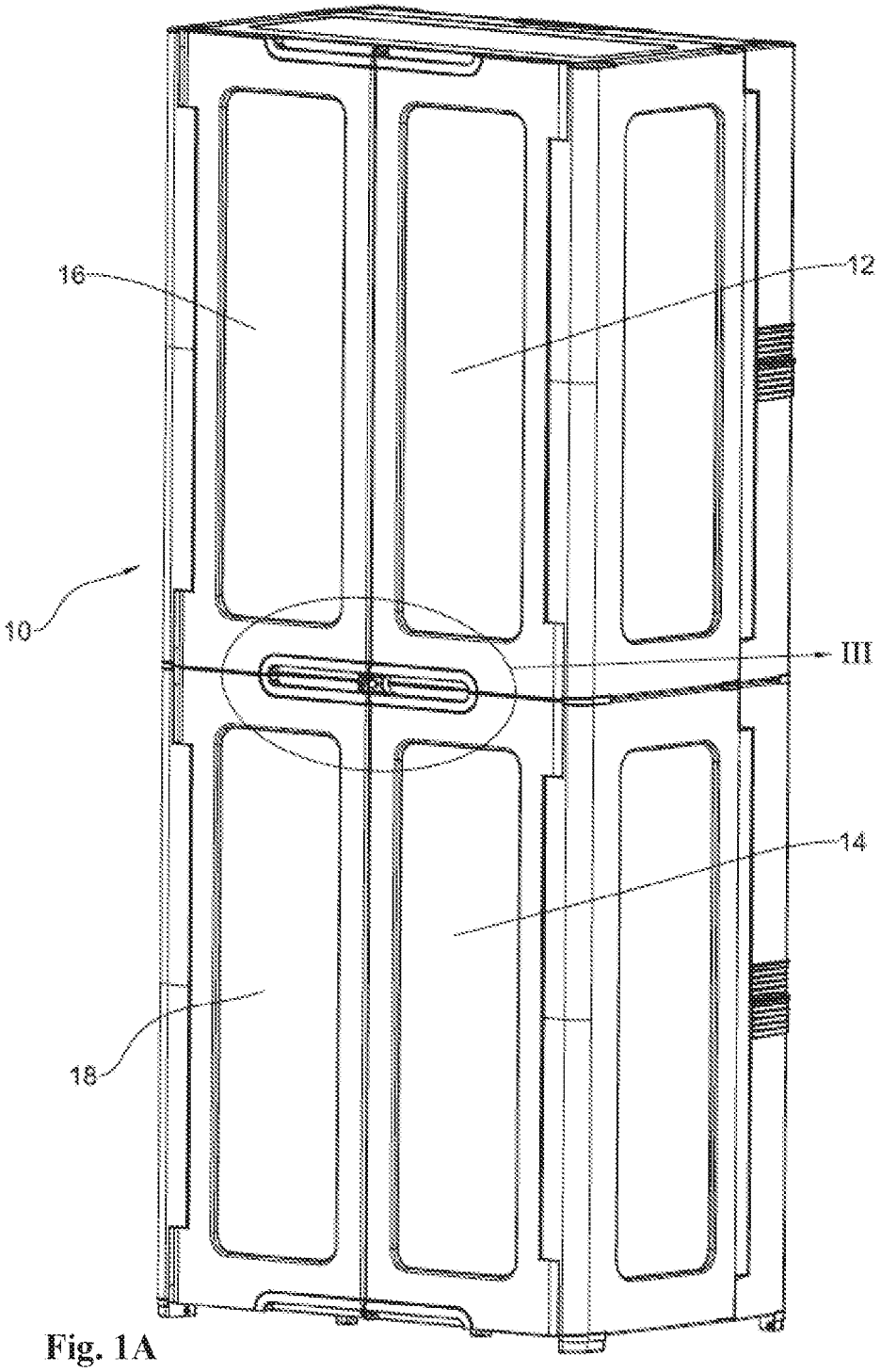
FIG. 1A is a perspective view of a 2×2 door cabinet, according to an aspect of the disclosure.

Attention is directed to the annexed drawings, showing in FIG. 1A a 2×2 cabinet generally designated 10 comprising (apart for its non-referenced side walls, top base, bottom base, back, shelves, etc.) a top right door 12, a bottom right door 14, a top left door 16 and a bottom left door 18. It is appreciated that in the given example components of the cabinet disclosed may be made of injection molded plastic material.

The four doors 12, 14, 16 and 18 are in fact the same molded element, i.e. one form of molded panel 22 (FIGS. 1B and 1C) can be used as any of the four doors. As seen in these Figures, the panel 22 at the orientation of FIG. 1B serves as a right-rail hinged door configuration (namely suitable as top door 12 and/or bottom door 14 in the cabinet 10 of FIG. 1A), whilst rotating the panel 22 upside-down, as in FIG. 1C, renders it suitable for use as a left-rail hinged door configuration (namely suitable as top door 16 and/or bottom door 18 in the cabinet 10 of FIG. 1A).

Figure 1B:
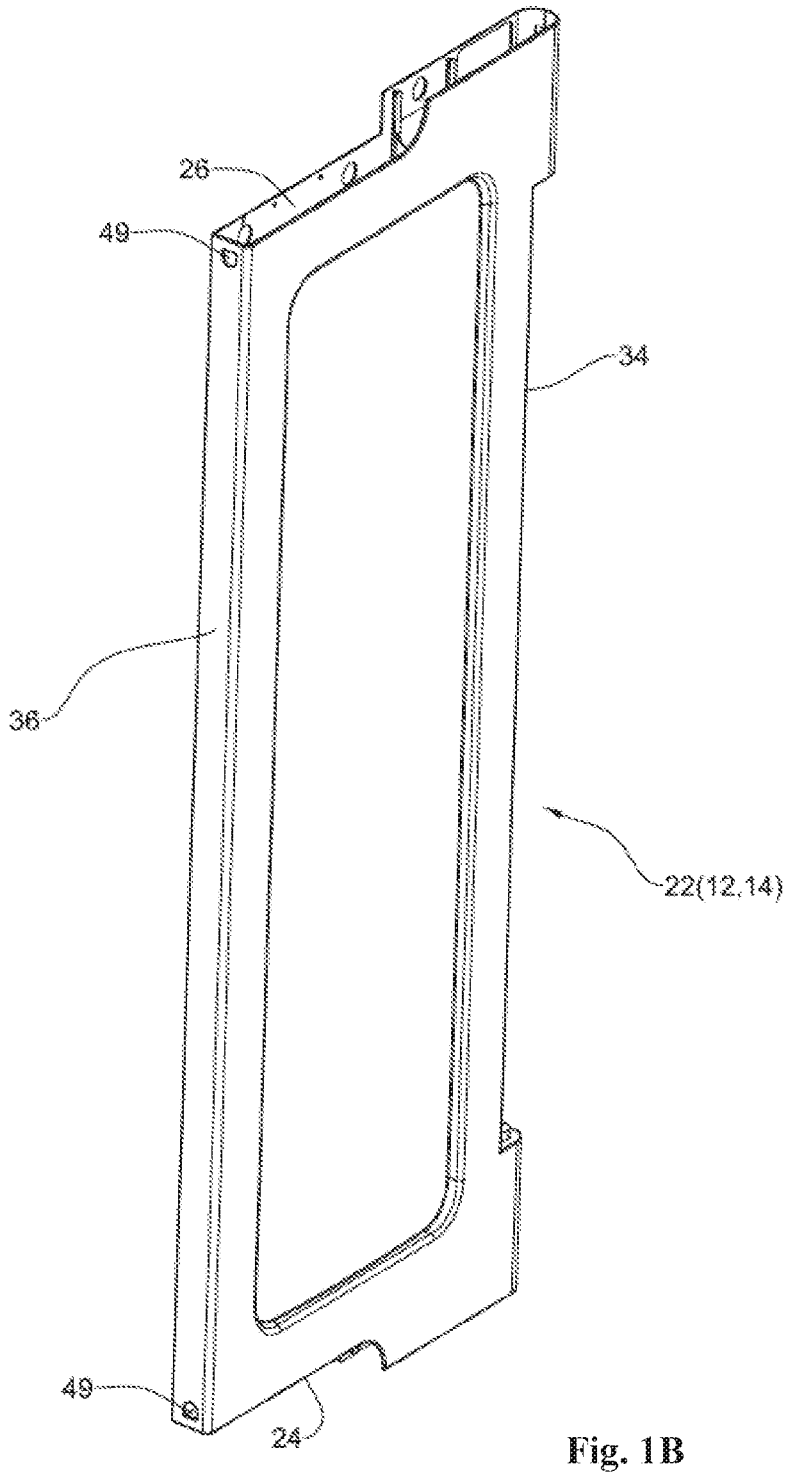
FIG. 1B is a door panel used in the cabinet of FIG. 1A, the door panel presented at a right rail hinged door configuration.
Figure 1C:
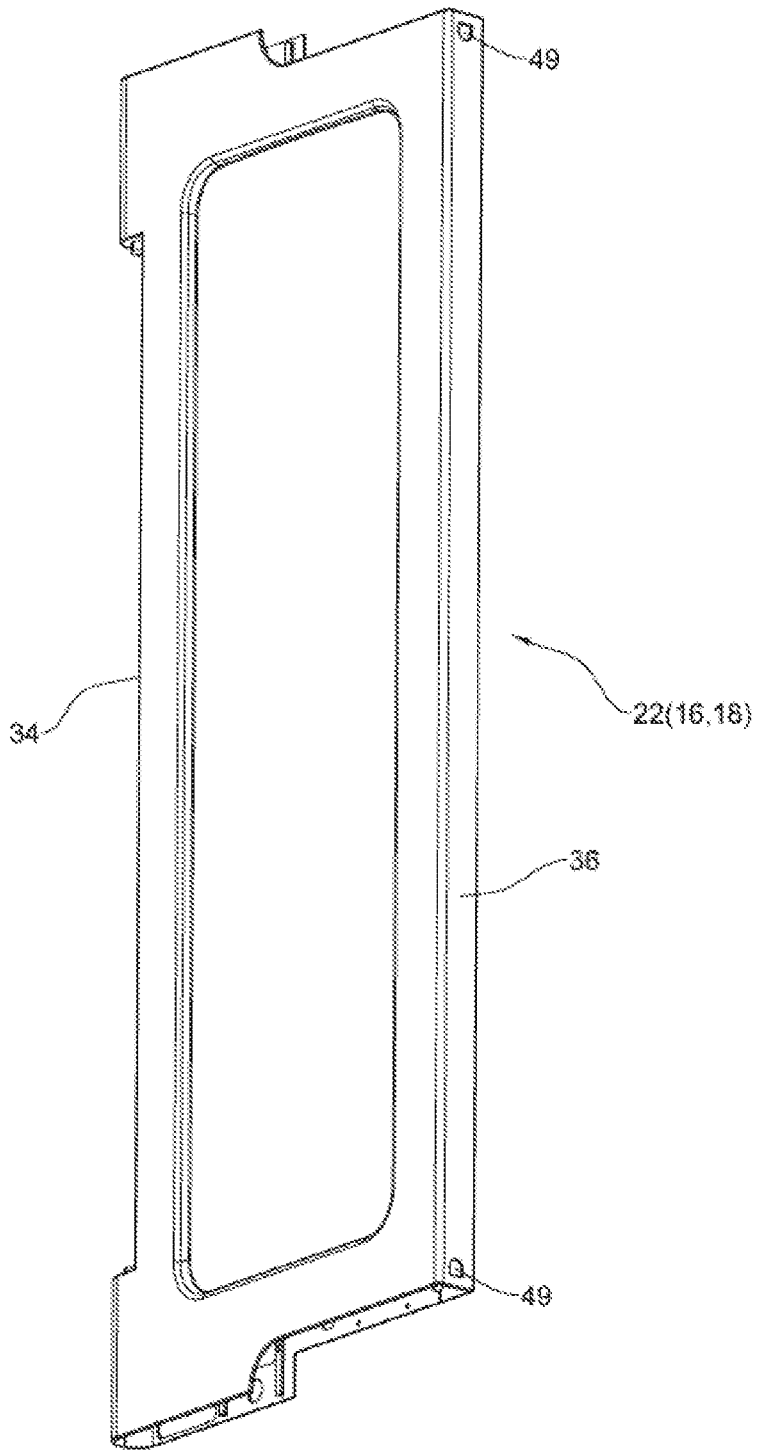
FIG. 1C illustrates the door panel of FIG. 1B, at a left rail hinged door configuration.
Figure 2:
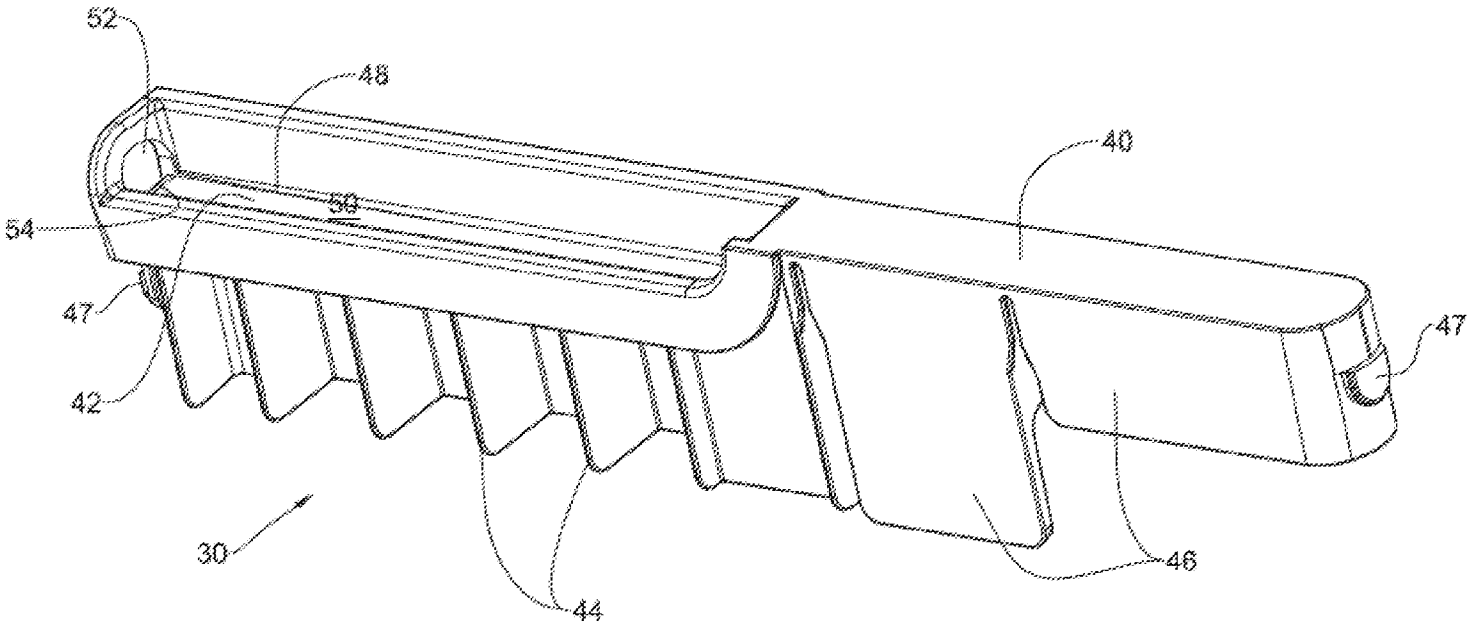
FIG. 2 is a front, right, top perspective view of a door reinforcing element, according to the disclosure.

It is seen in FIGS. 1B and 1C that the panel 22 is configured at its respective bottom/top rail with a first cavity 24 and a second cavity 26, each configured for snapingly receiving therein a door reinforcing element 30 (seen in detail in FIG. 2). Each such door reinforcing element 30 extends within the respective opening of the top/bottom rail of the panel 22, between respective hinge stile edge 34 to the respective locking stile 36, thus rigidifying/stiffening the panel board 22.

Figure 3A:
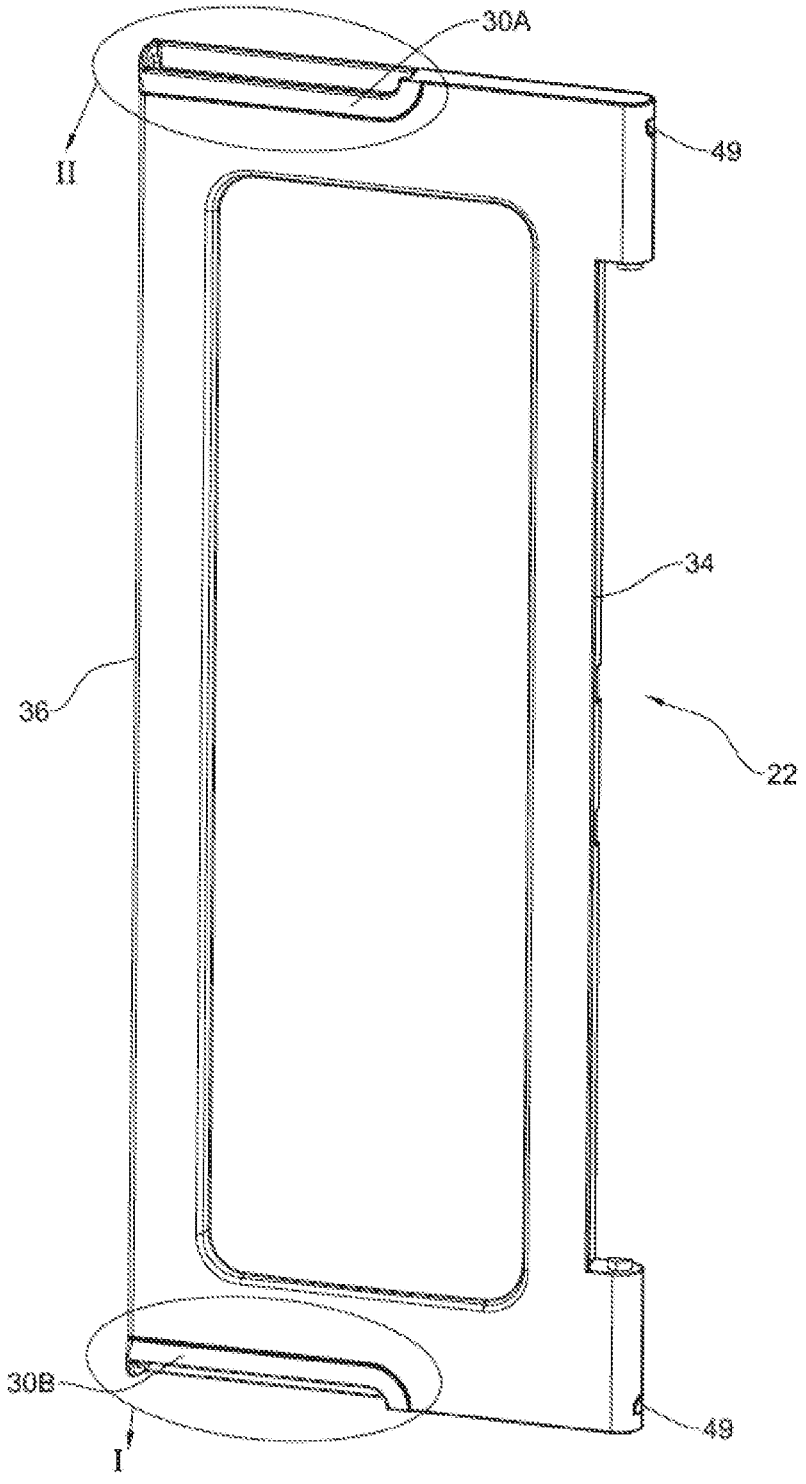
FIG. 3A is illustrates the door panel of FIG. 1B assembled with a top door reinforcing element and a bottom door reinforcing element, ready for mounting to the cabinet.
Figure 3B:
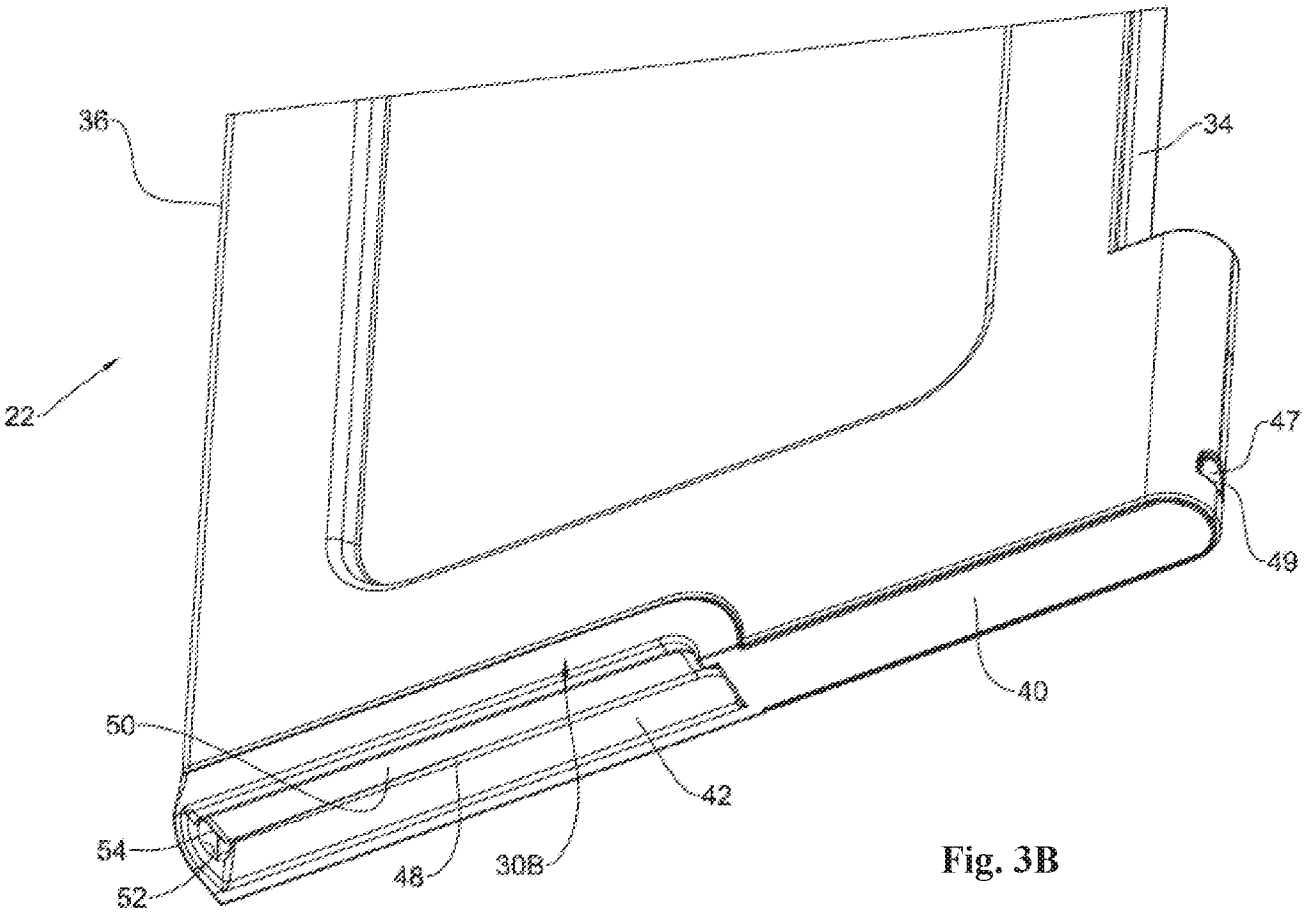
FIG. 3B is an enlargement bottom perspective view of the portion marked I in FIG. 3A.
Figure 3C:
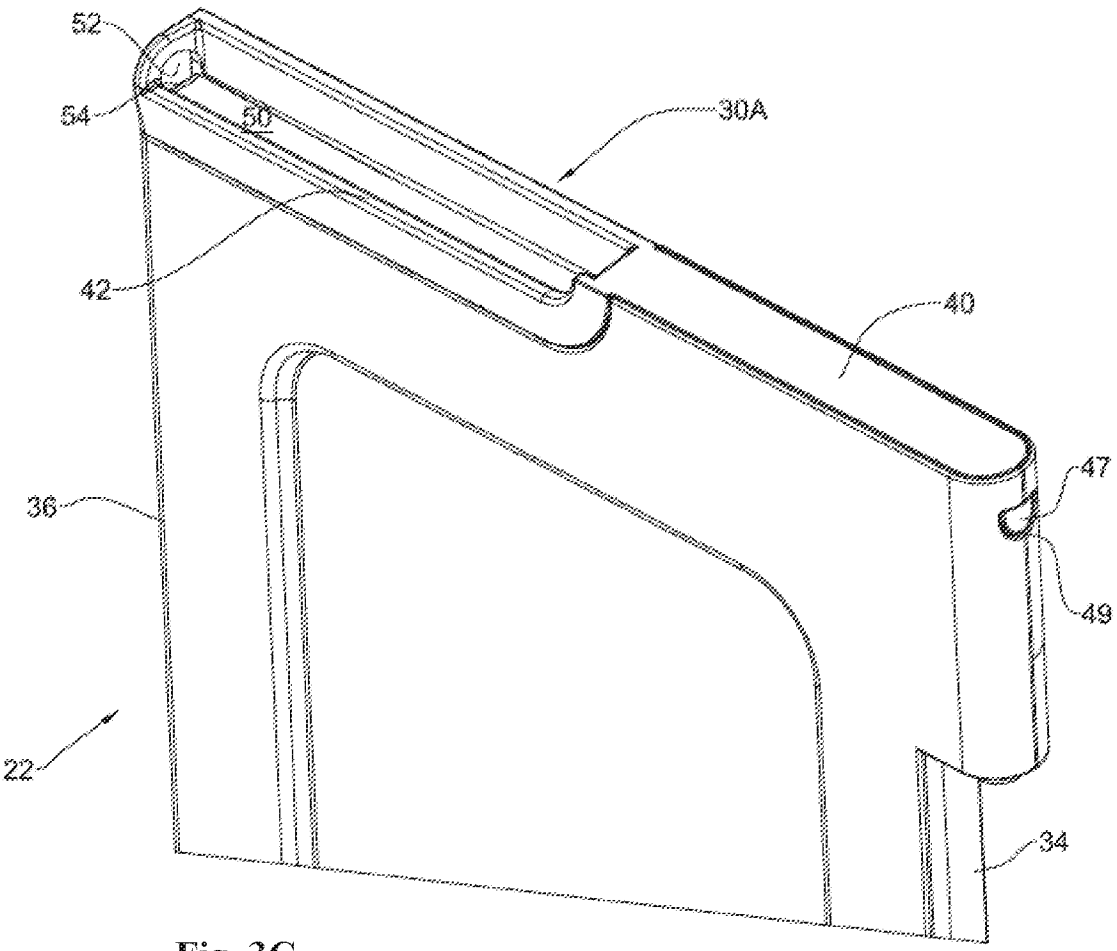
FIG. 3C is an enlargement top perspective view of the portion marked II in FIG. 3A.
Figure 3D:
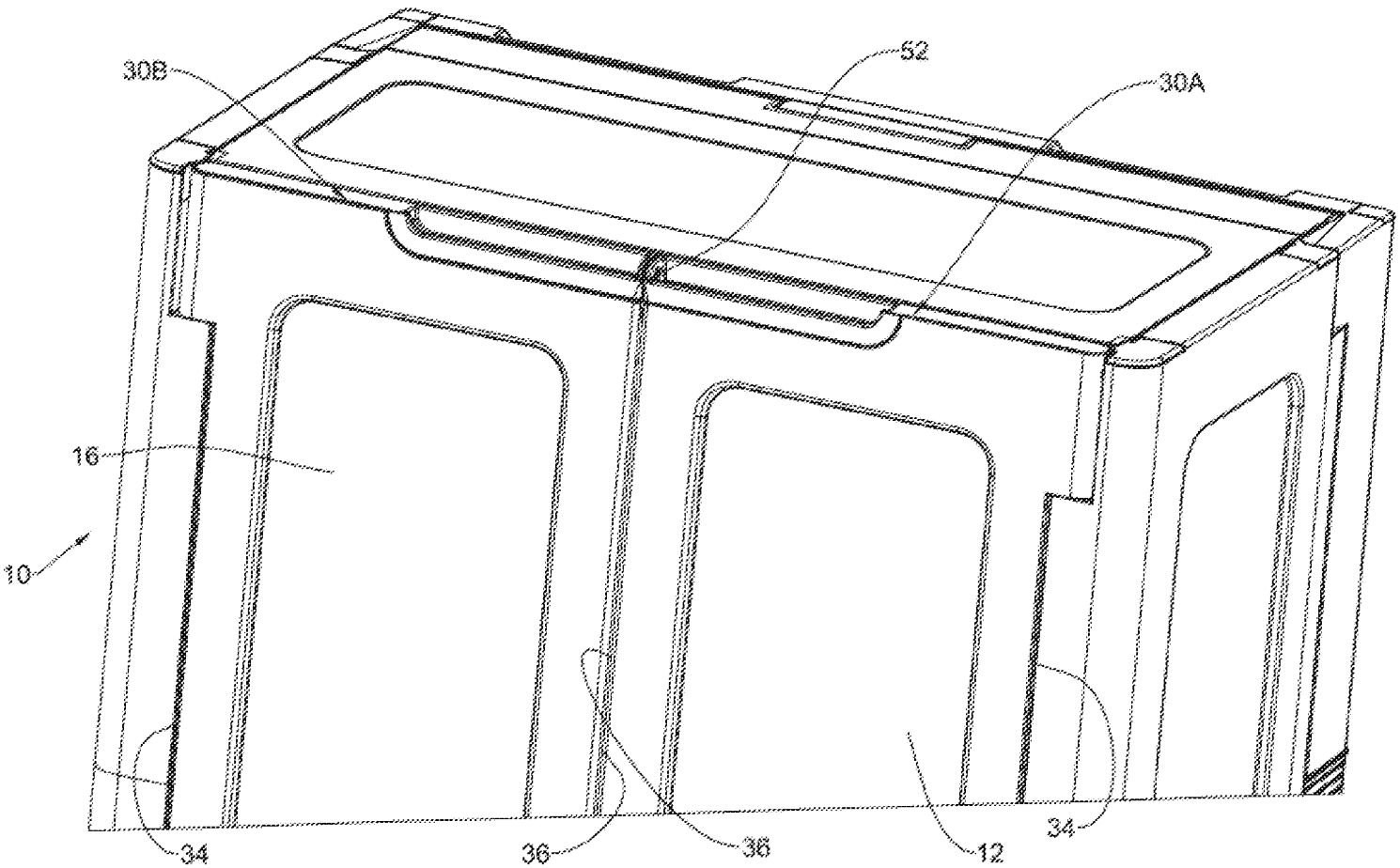
FIG. 3D is an enlargement top perspective view of a top of the cabinet of FIG. 1.
Figure 3E:
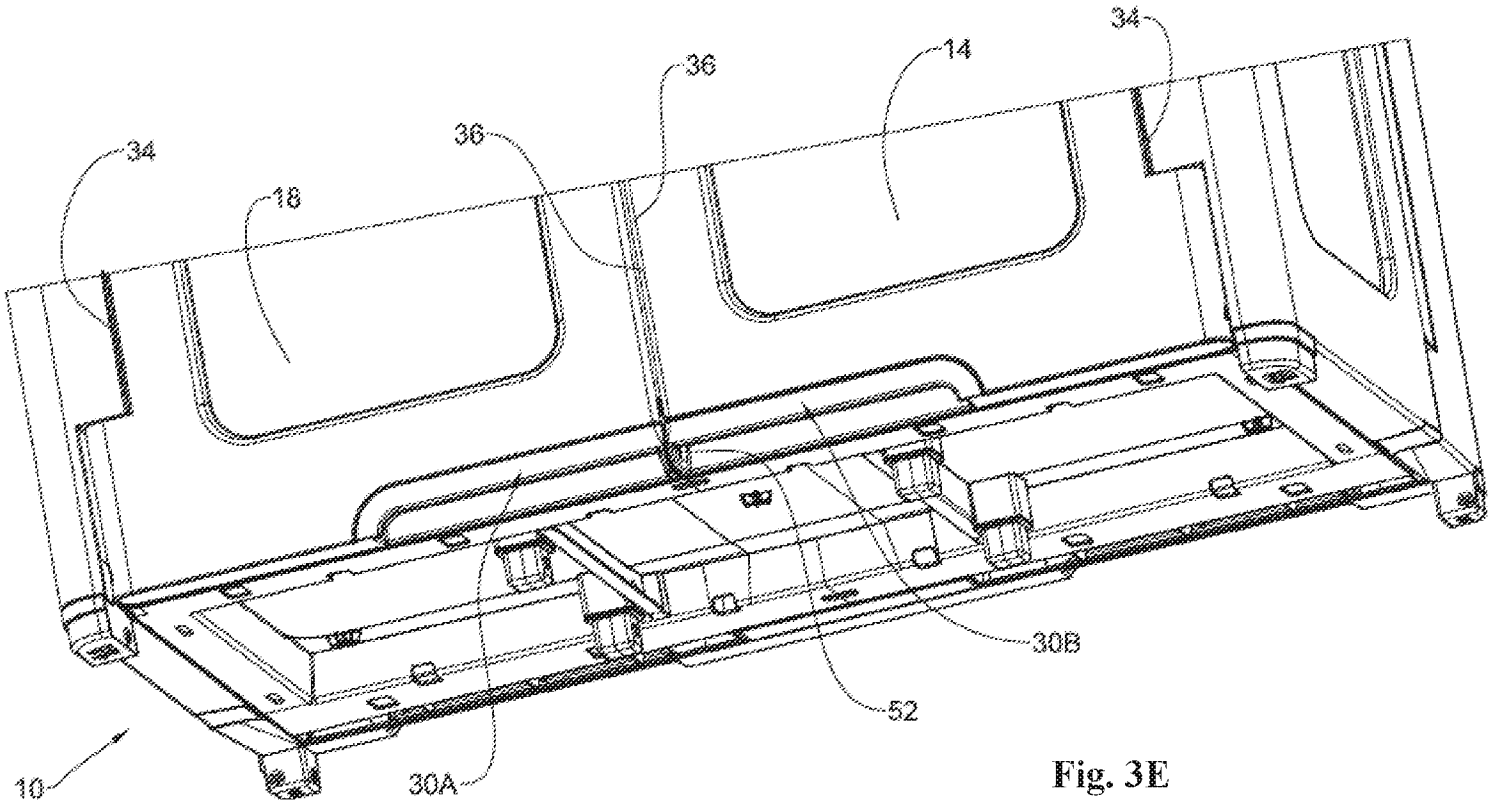
FIG. 3E is an enlargement bottom perspective view of a bottom of the cabinet of FIG. 1.

As will be clarified herein after with reference to FIGS. 4A-4D, there is a designated right side door reinforcing element 30 member and a left side member door reinforcing element. Each door reinforcing element 30 comprises a flat top surface 40, which at the assembled position extends flush with a respective top/bottom edge of the door panel (best seen in FIGS. 3A-3C).

Door reinforcing element 30 further comprises a handle portion 42 configured such that at the assembled position it extends near an inside edge of the door (i.e. near the locking stile 36 and remote from the hinge stile 34), and a plurality of support ribs 44 and flanges 46 configured for reinforcing the panel edge and stabilized positioning of the door reinforcing element 30 within the cavity at the open rail end of the door panel (24; 26), whereby lateral projections 47 serve for snapingly engaging with openings 49 at the panel 22, for arresting the door reinforcing element 30 within the cavity (24; 26) at the panel's respective rail. Handle portion 42 is configured with a recessed groove 48 having a flat base surface 50, extending towards an opening 52 and configured at that location with an indention 54, for snapingly arresting a locking member (80 in FIGS. 5A-5B) as will be discussed hereinafter.

Figure 3F:
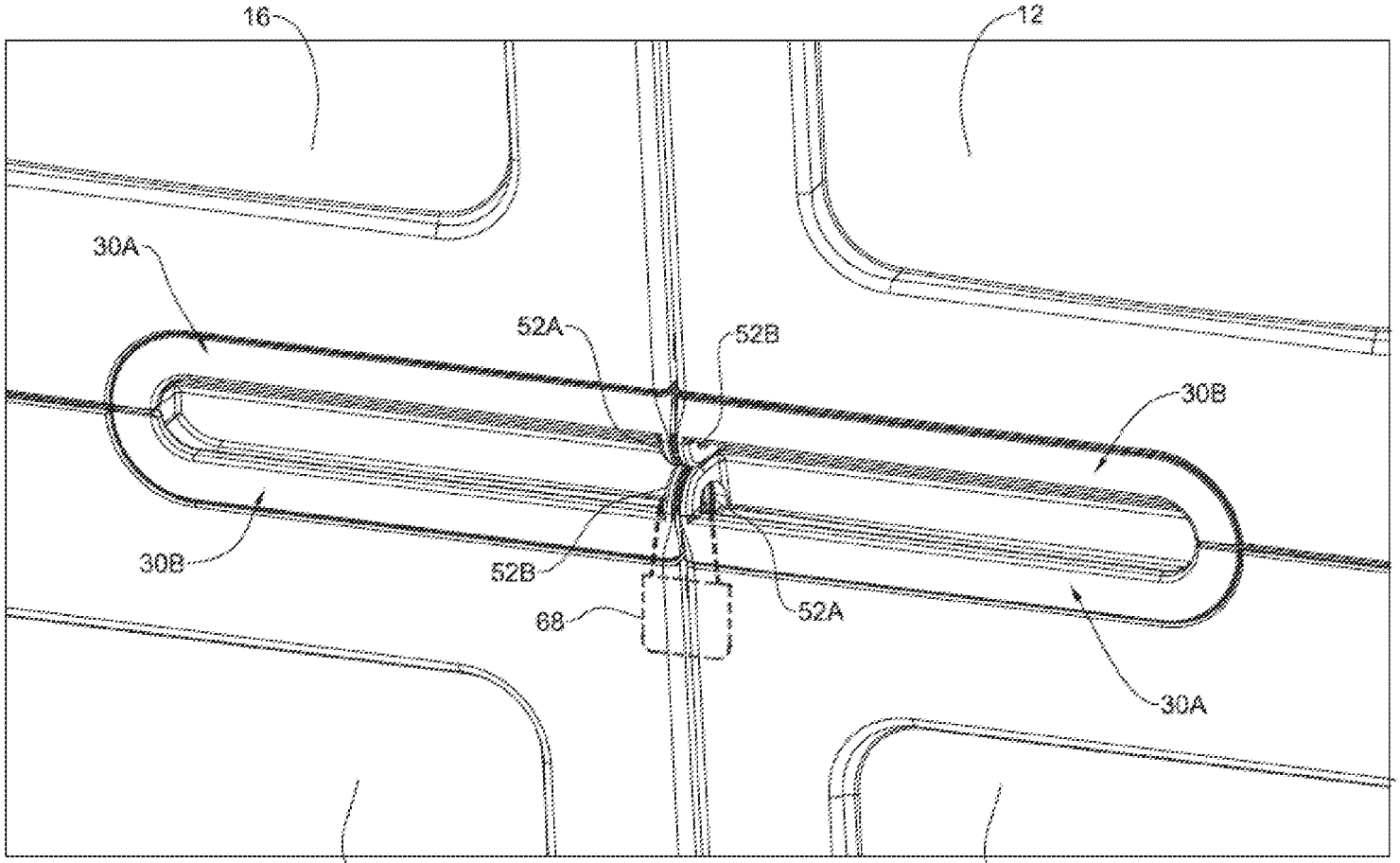
FIG. 3F is an enlarged view of the center handle portion marked III in FIG. 1A.
Figure 3G:
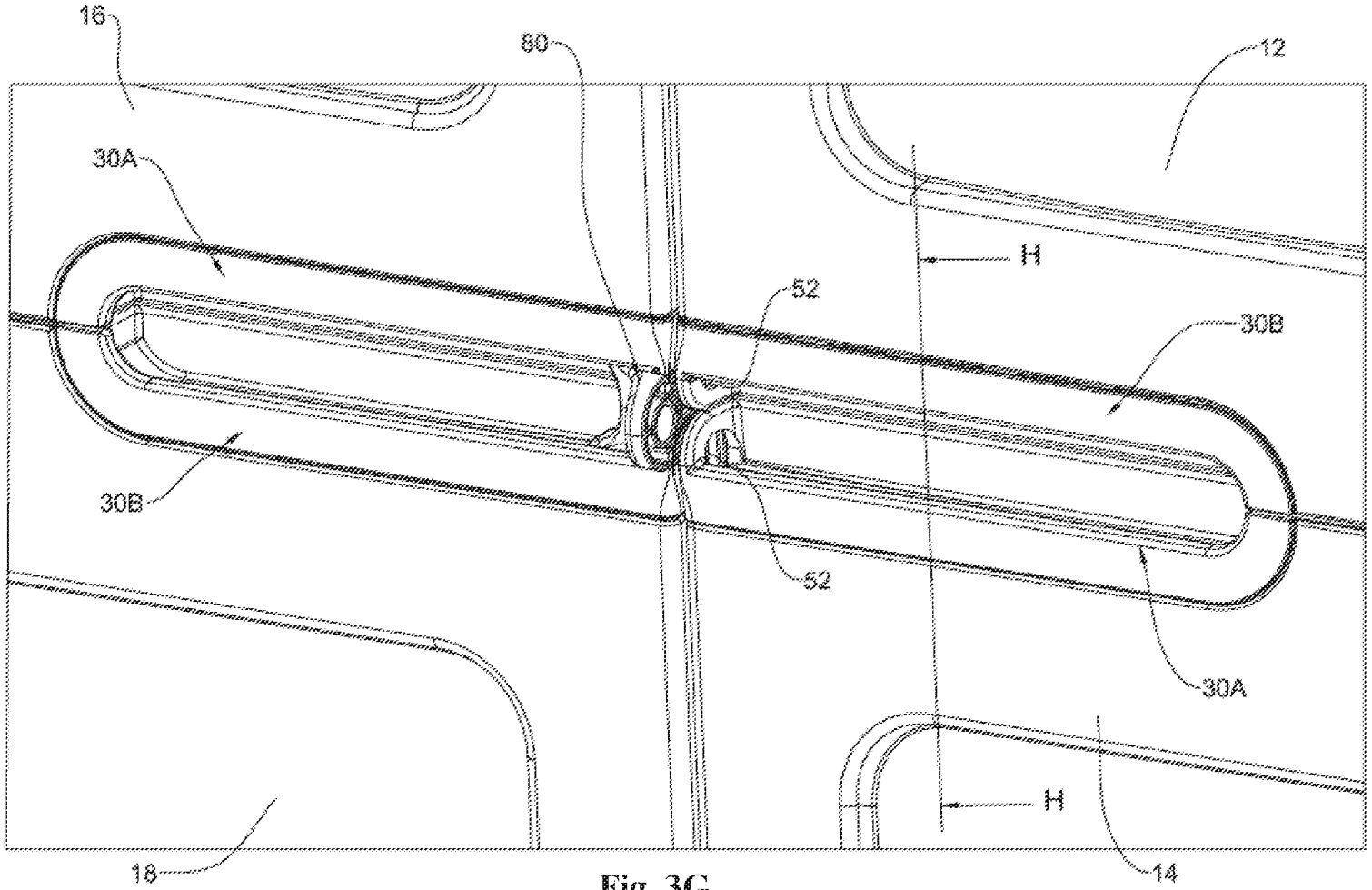
FIG. 3G illustrates of the center handle portion of FIG. 3F, with one locking member engaging the left side doors of the cabinet.
Figure 3H:
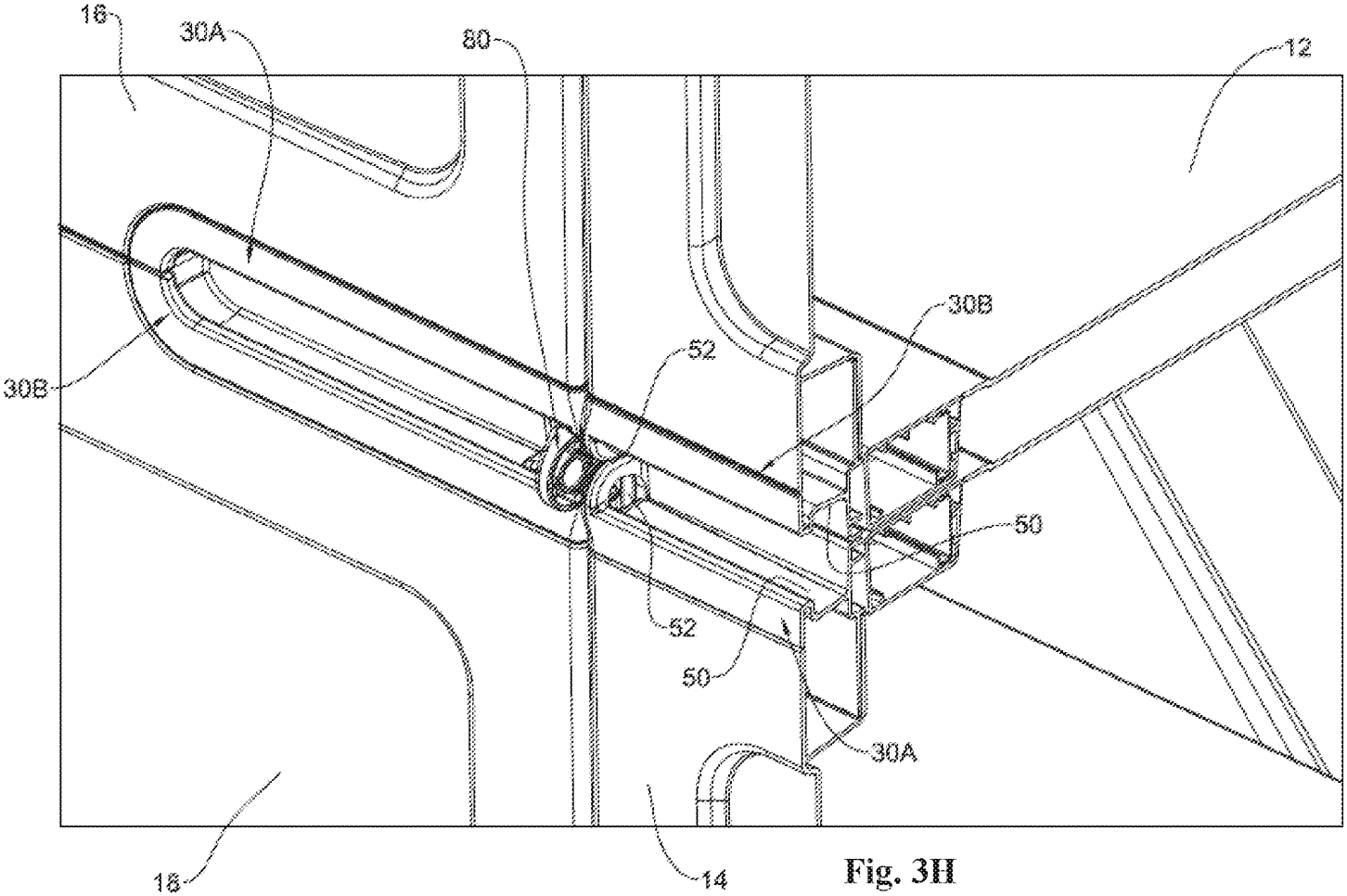
FIG. 3H is a vertical section along line H-H in FIG. 3G.
Figure 6:
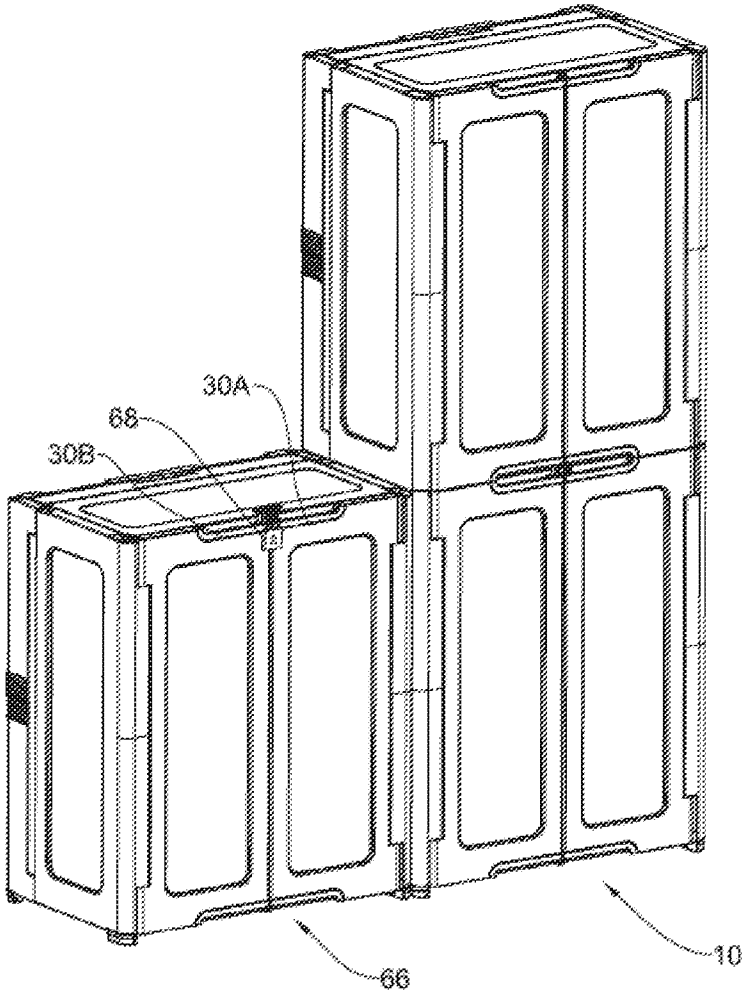
FIG. 6 is a an example of a cabinet assembly comprising a two door cabinet at a side-by-side orientation, and a 2×2 cabinet.

At the event that the handle portion 42 is left free, i.e. without inserting a locking member 80 (as will be discussed below), neighboring doors at a side-by-side configuration (such as doors 62 and 64 of cabinet 66 in FIG. 6) can be locked to one another at their closed position, with a padlock 68 (single shackle or U-shaped shackle) extending through the opening 52 of the neighboring respective door reinforcing element 30A and 30B (as seen in FIG. 3F).

In FIG. 3F there is an enlarged view of the center handle portion of the cabinet 10, wherein the four neighboring door reinforcing elements 30A and 30B are seen, however without a locking member 80 introduced. Thus, each of the four doors 12, 14, 16 and 18 is independently pivotable between its closed and open position; further, each pair of side-by-side doors, i.e. top doors 12 and 16, and bottom doors 14 and 18, can be locked to one another by introducing a pad lock (schematically represented by dashed lines 68, applied over the bottom doors only) through the respective vacant openings 52A and 52B, now serving as locking eyes, thereby locking the respective doors and preventing unauthorized opening thereof.

Figure 5A:
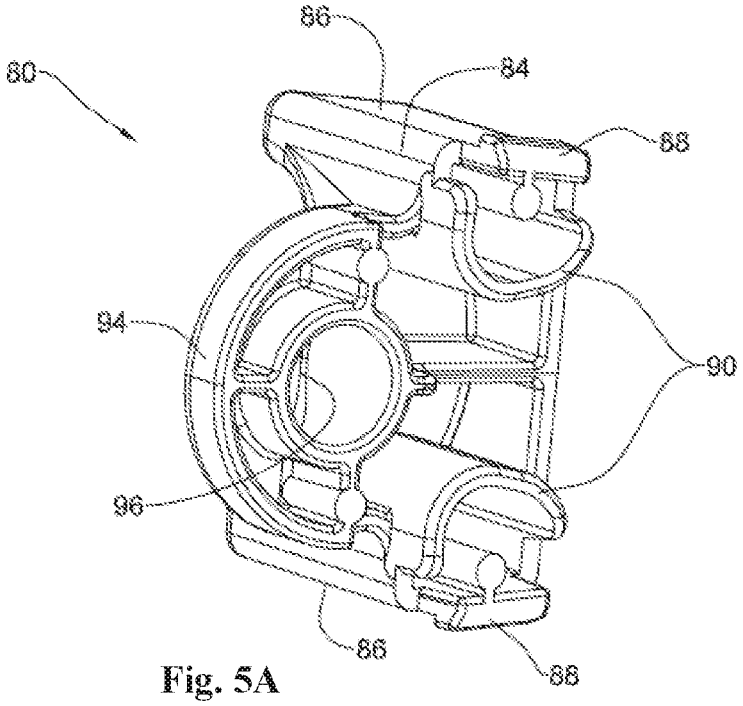
FIGS. 5A and 5B are left and right side perspective views, respectively, of a locking member according to an aspect of the disclosure.
Figure 5B:
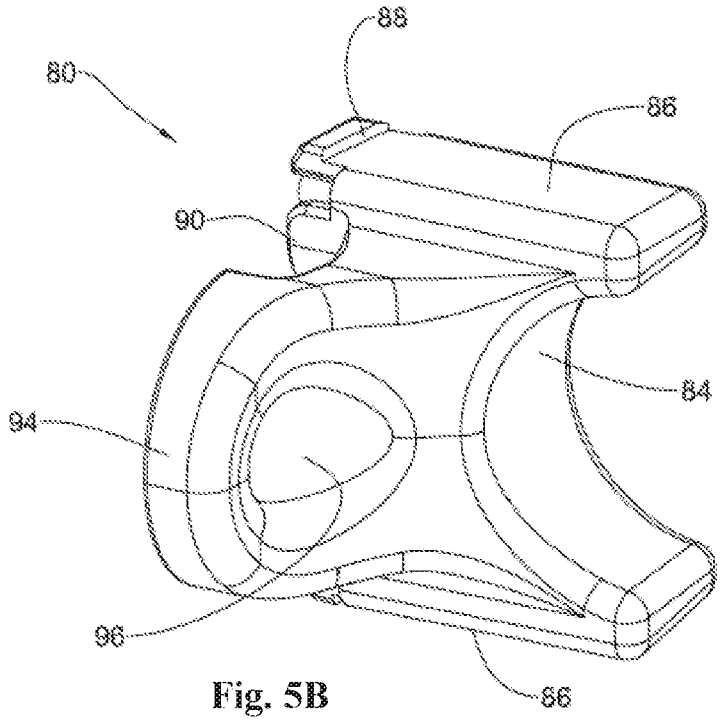

FIGS. 5A and 5B illustrate a locking member 80 according to an example of the disclosure, the locking member 80 generally has an L-shape and comprises a first leg portion 84 and a second leg portion 94. The first leg portion 84 has two opposite flat sliding surfaces 86 sized and shaped for snugly receiving and sliding over the flat base surface 50 within recessed groove 48 of the door reinforcing element 30. An end of the respective sliding surfaces 86 is provided with chamfered snap protrusion 88, configured for snapingly arresting by indentions 54 at the door reinforcing element 30. Furthermore, the locking member 80 is provided with a support and locking projection 90, configured for snugly arresting within opening 52 of the respective door reinforcing element 30. The second leg portion 94 is configured with a locking member 96 and can optionally serve as a gripping handle.

The arrangement is such that the locking member 80 is applied first to a door reinforcing element 30B bottom door panel (e.g. bottom left door 18) within recessed groove 48 and is slidingly displaced over the flat base surface 50 towards the locking stile end, whereupon the protrusion 88 snapingly arrests by indention 54 at the door reinforcing element 30B with simultaneous arresting of the locking projection 90 within opening 52 of the respective door reinforcing element 30B, whereby the locking member 80 is now fixed to a bottom door panel 18 of a pair of doors (18 and 16). Then, the top door (16 respectively) is manipulated and slightly twisted (owing to resiliency of the door panel) such that the locking member 80 snaps into position within the door reinforcing element 30A of the top left door panel 16, similar to the arrangement discussed hereinbefore regarding door reinforcing element 30B, whereby the two doors 16 and 18 become integrated (FIGS. 3G, 3J, 4A, 4C), i.e. are affixed to one another such that displacing one of the doors entails corresponding, simultaneous displacement of the attached door.

Figure 3I:
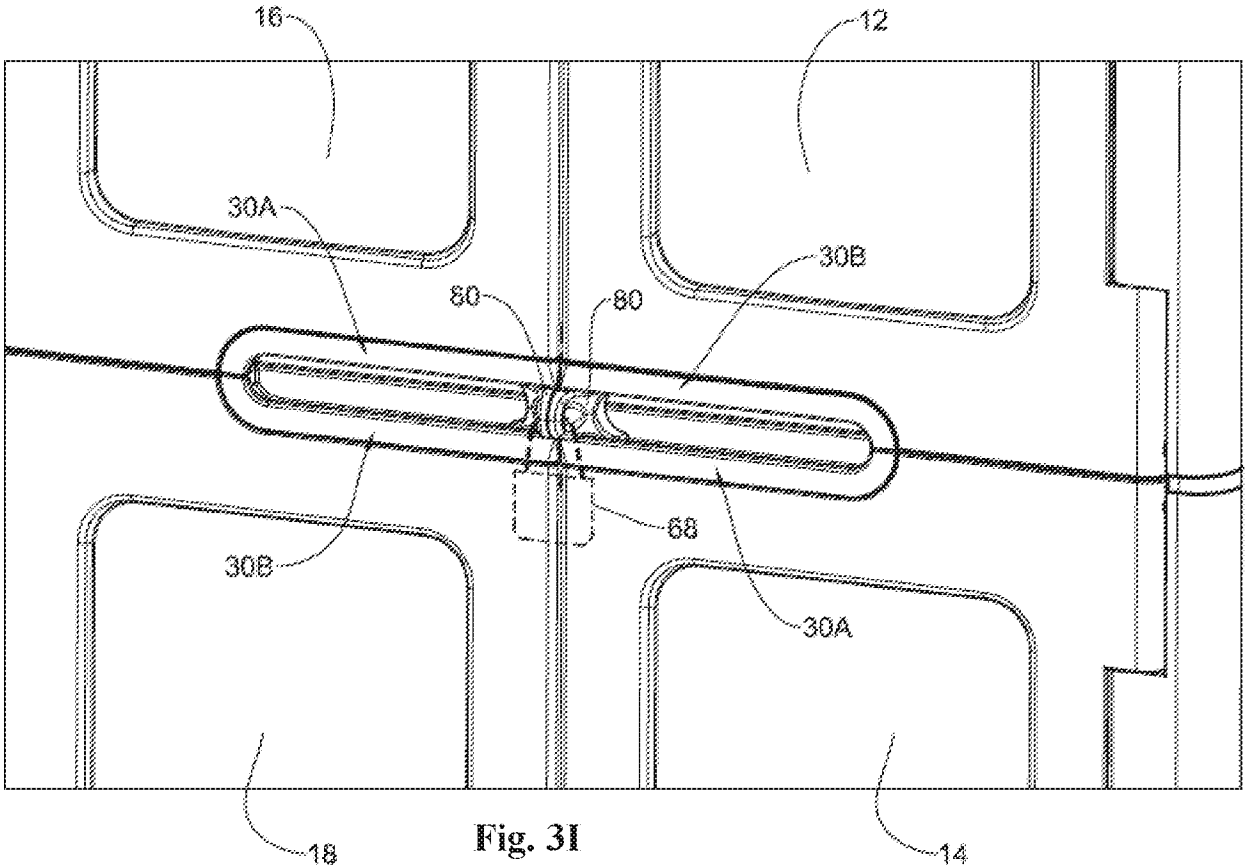
FIG. 3I is the same as FIG. 3G, however with two locking members secured, one engaging the left side doors and the other engaging the right side doors of the cabinet.
Figure 3J:
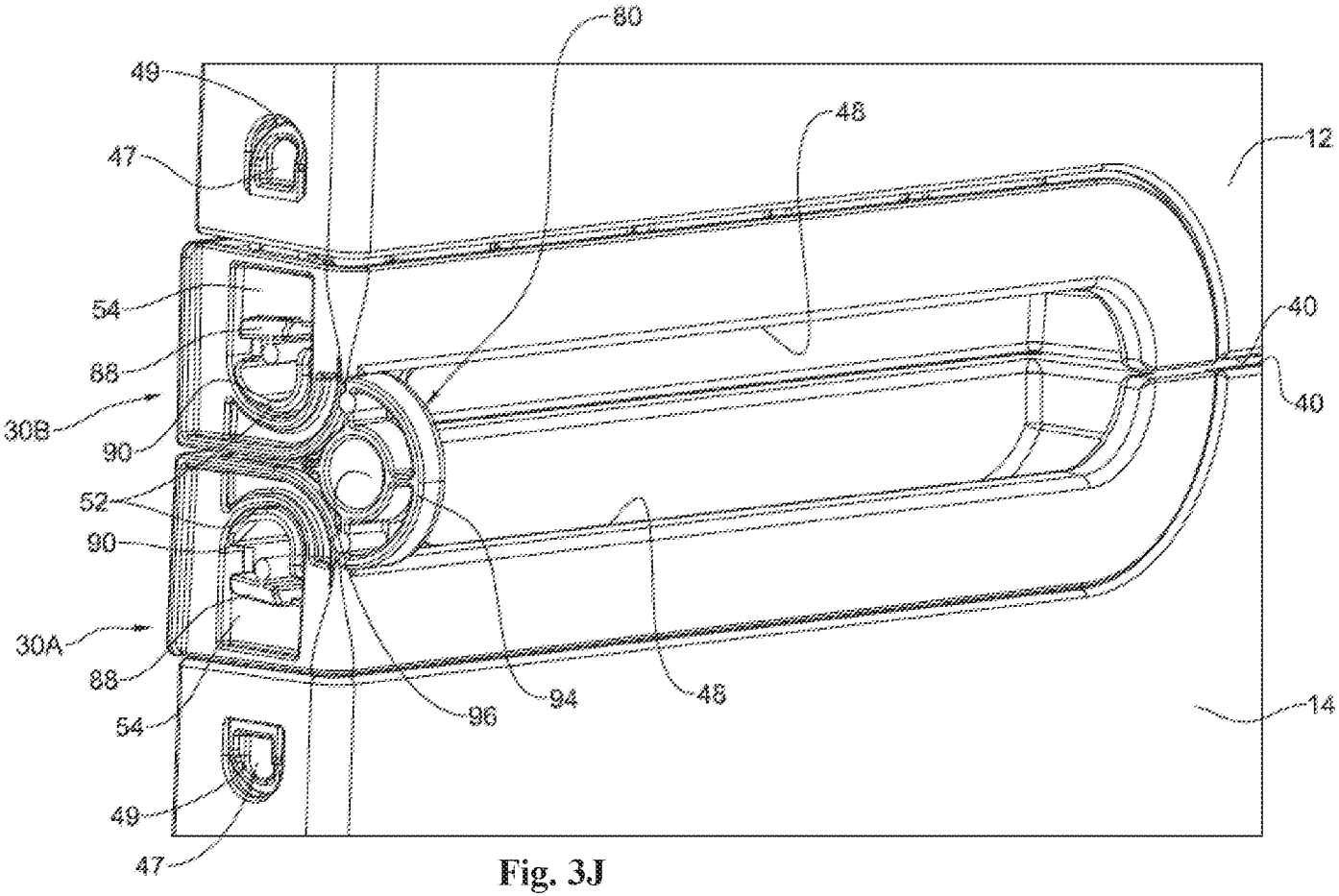
FIG. 3J is a left side perspective view of the right side doors fitted with an interlocking locking member.

The same arrangement is then applied to the right pair of doors, namely bottom right door panel 14 and top right door panel 12, wherein a locking member 80 is applied and interlocked between said doors, (FIGS. 3I and 3J), whereupon the two doors 14 and 12 integrate and will simultaneously displace. Further, a single pad lock can now be applied (schematically represented by dashed lines 68) for locking of all four door panels (12, 14, 16 and 18).

Figure 4A:
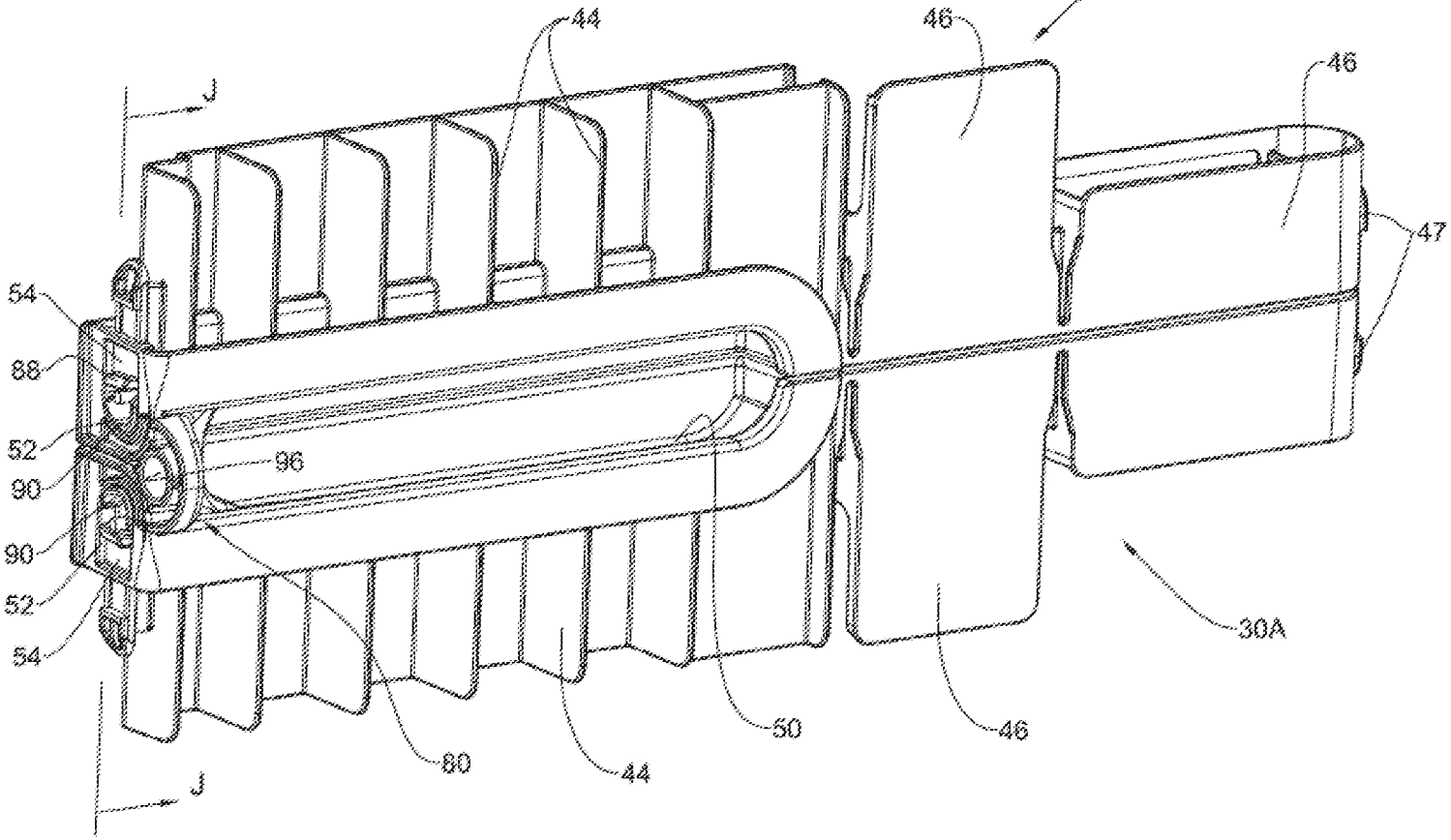
FIG. 4A is a left side perspective view of the top reinforcing element and the bottom reinforcing element of the neighboring right side doors, with an interlocking locking member engaged therebetween.
Figure 4B:
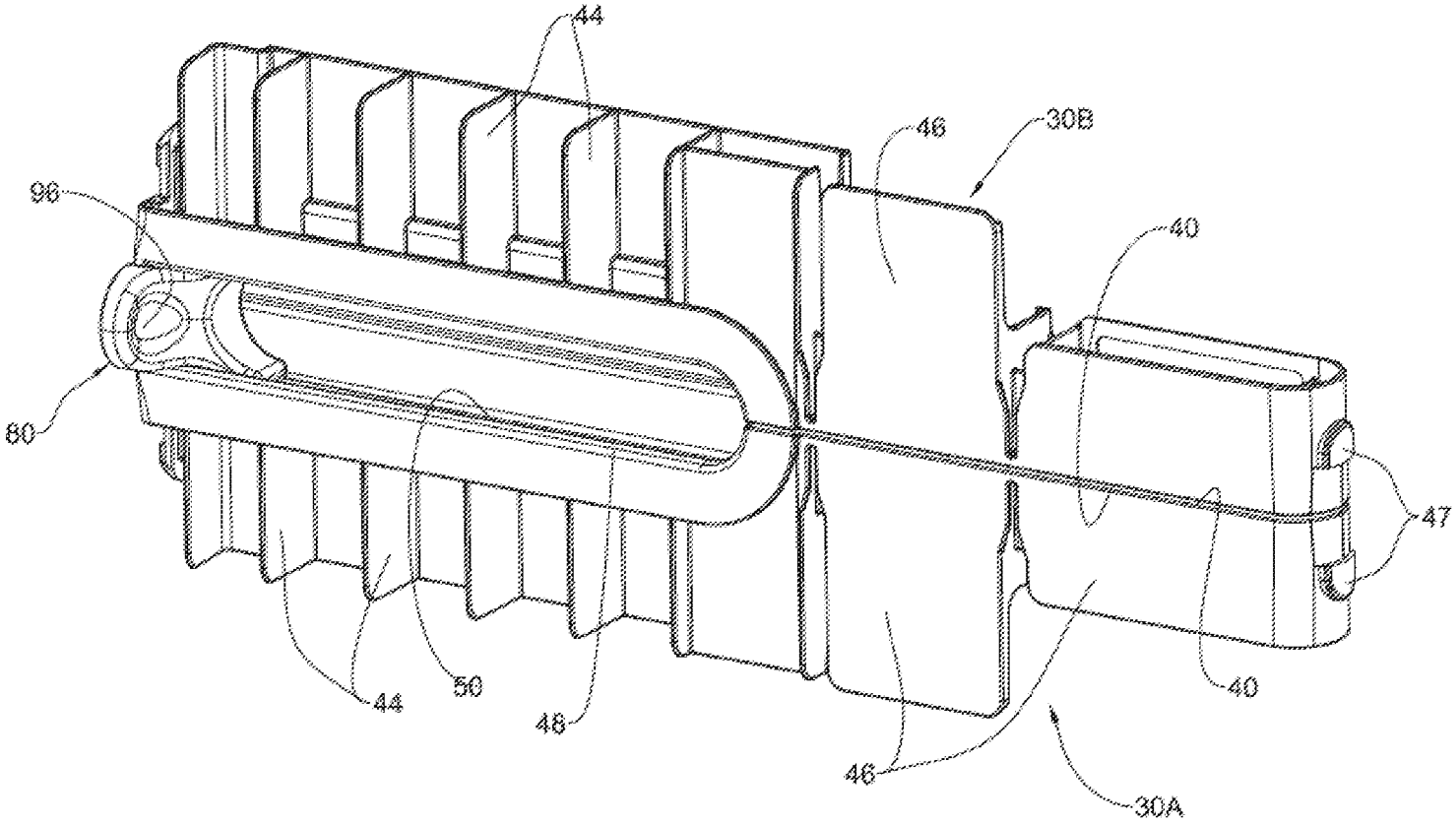
FIG. 4B is a right side perspective view of the setup of FIG. 4A.
Figure 4C:
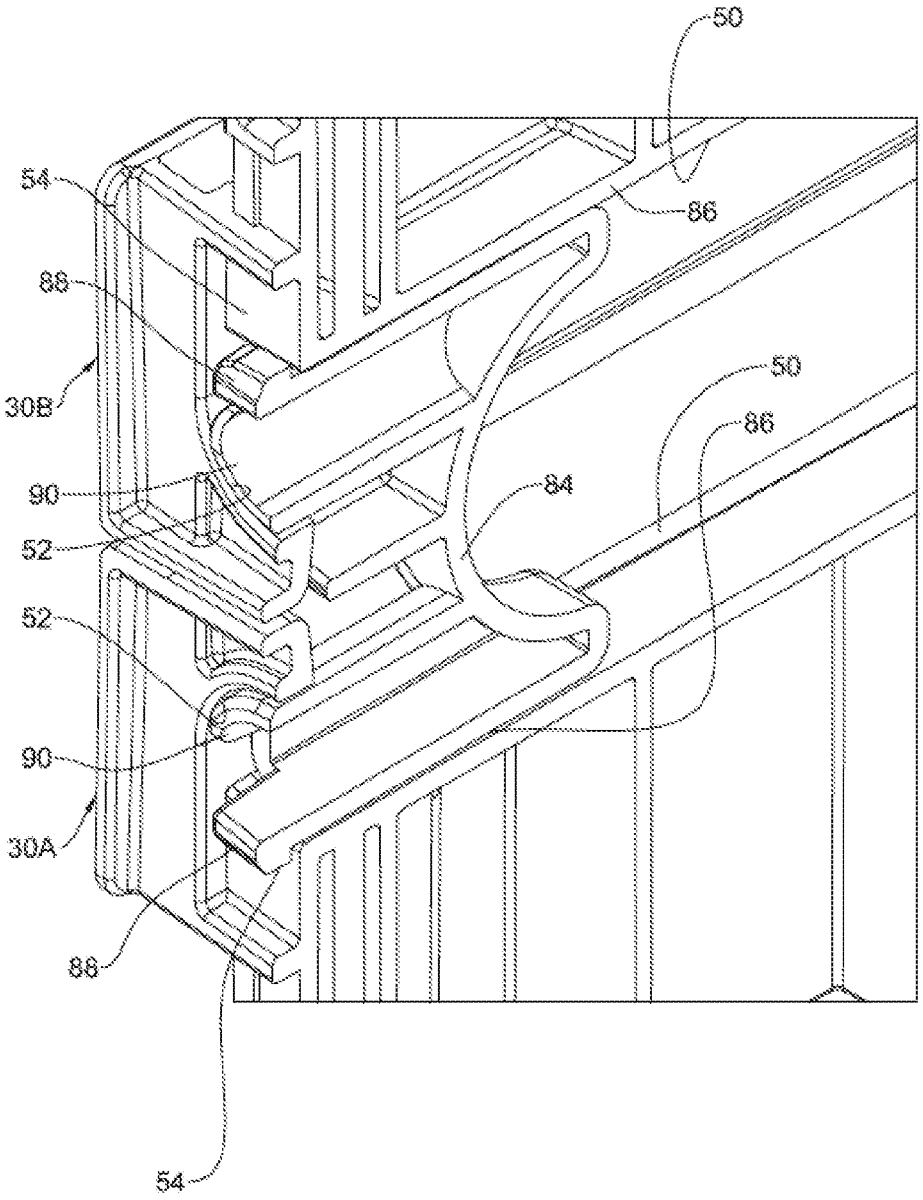
FIG. 4C is an end portion of a section along line J-J in FIG. 4A.
Figure 4D:
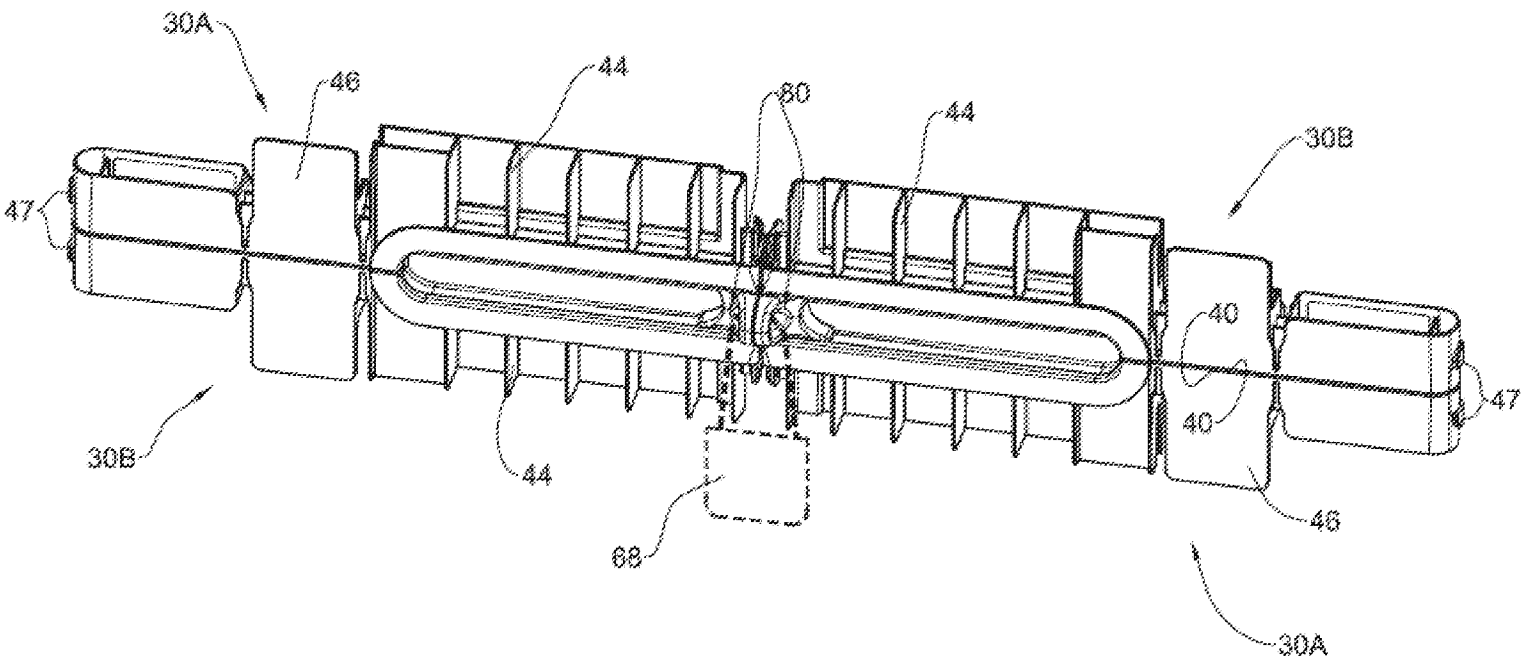
FIG. 4D is a right side perspective view of the top reinforcing elements and the bottom reinforcing elements of neighboring doors of the 2×2 cabinet, with interlocking locking members engaged therebetween the respective top and bottom door panels.

For sake of clarity, in FIG. 4B there is illustrated a pair of door reinforcing elements 30A and 30B integrated to one another by a respective locking member 80 interlocked therebetween, as explained herein, wherein the two door reinforcing elements 30A and 30B (with their associated doors; not shown) become united one with the other. In FIG. 4D there are illustrated two pairs of door reinforcing elements 30A and 30B integrated to one another by a respective locking member 80 interlocked therebetween, as explained herein, wherein each of the left set of doors and right set of doors (doors not shown) become united with one another respectively.

It is appreciated that the locking members 80 can be readily removed, at any time, at a reverse sequence of mounting to that described hereinabove.

It is noted, that at the integrated position of the doors, the respective flat surface 40 of the top door reinforcing elements 30A and 30B are in close proximity and can extend flush over one another.

Further realized, applying the two locking members to the doors of a 2×2 cabinet in fact convert it into lockable, two doors at a side-by-side door configuration. Also, the integration of doors to one another through a locking member can take place in larger scale, for example, a 2×6 door cabinet can be manipulated so that three left side doors and/or three right side doors are integrated to one another (not shown), thereby resulting in a united side-by-side door configuration, wherein a top rail of a bottom left door panel is secured to a bottom rail of a middle left door, and further a top rail of the middle left door is secured to a bottom rail of the top left door panel.

Figure 7:
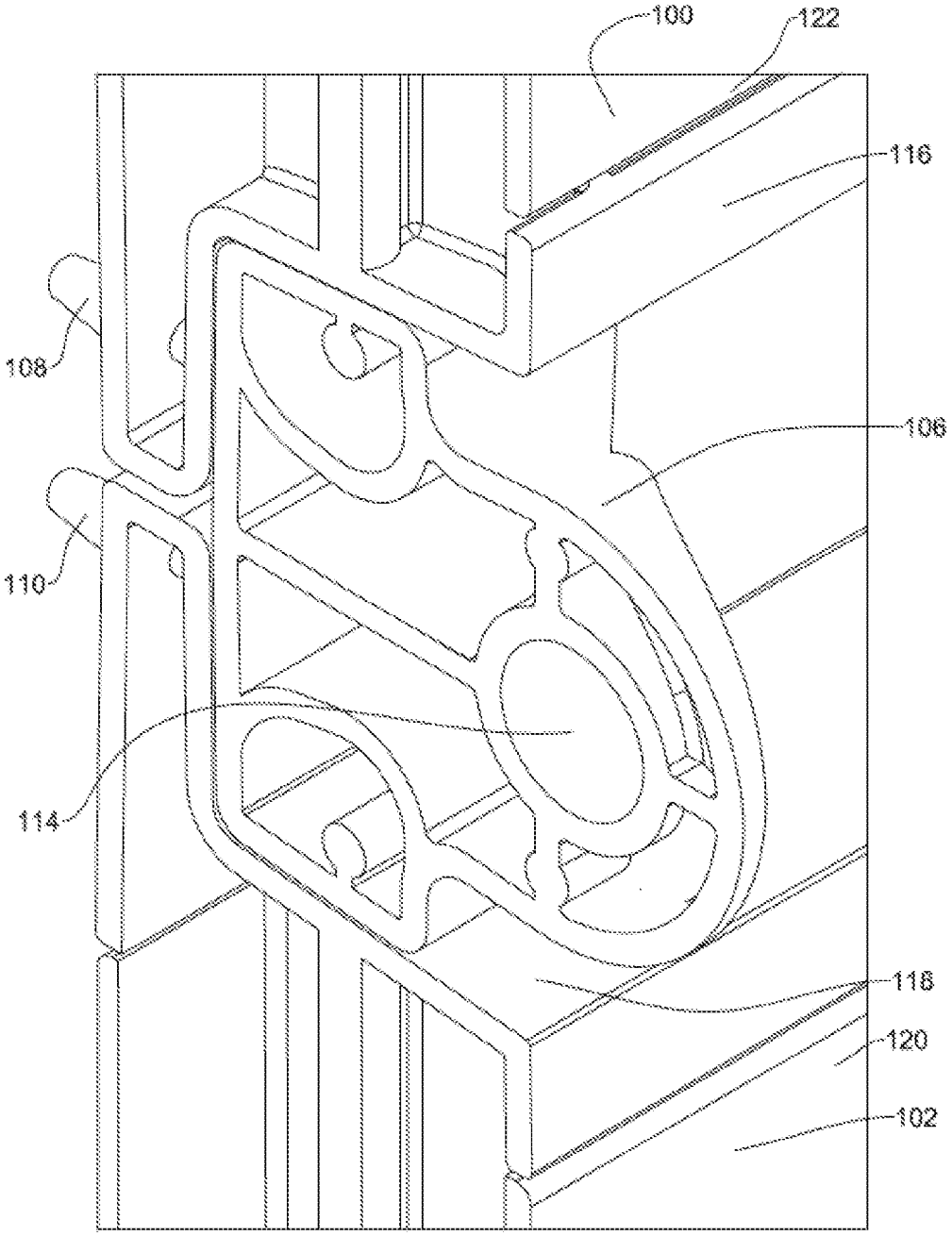
FIG. 7 is a longitudinal perspective section through a portion of two doors (door over door configuration), articulated to one another through a locking member snapingly articulated to the doors.

Further attention is directed to FIG. 7, illustrating a top door 100 over a bottom door 102, of a cabinet (not shown), wherein at a neighboring portion of the two doors there is applied a locking member 106 snapingly fastened at 108 and 110 to the two doors 100 and 102, respectively, thereby uniting the two doors, such that they now act in an integrated fashion. Similar to the previous example, the locking member 96 is configured with a locking eye 114 for locking with a neighboring locking eye (not shown). It is appreciated that whilst the locking member 106 is fastened to the respective doors 100, 102 at a handle portion 116, 118, respectively, other locations can be configured, however at the respective top rail 120 and bottom rail 122 of the doors, and near the locking stile thereof. The handle portion of the door panels can be integral with or assembled thereto.

It is also appreciated that snap-type fastening as disclosed herein before is an example and other arrangements can be facilitated as well, such as a threaded coupling, wedge-coupling, etc.

The disclosed arrangement is such that at door-over-door orientation the locking member can be removed upon displacing the door panels into an at least partially open position. Accordingly, at the closed position of the doors the locking member articulating the two doors cannot be manipulated/removed.

The invention claimed is:

1. A door panel for a cabinet, said door panel being fully interchangeable, wherein the door panel is configured to serve as any one of a top door, a bottom door, an intermediate door, a left rail hinged door and a right rail hinged door, and wherein at least one of a top rail and a bottom rail of the door panel is configured for receiving a door reinforcing element, said door reinforcing element comprising a recessed groove configured for slidingly receiving a locking member and arresting the locking member at a locking stile end of the door reinforcing element, bringing the locking member of the panel to alignment with a locking member of a neighboring door, wherein the locking member is generally L-shaped, with a first leg portion and a second leg portion, the first leg portion configured for simultaneously arresting within a top door rail of a bottom door panel and within a bottom door rail of a top, neighboring door panel.

2. A cabinet comprising two or more door panels of claim 1.

3. The cabinet of claim 2, wherein the locking member is attached at a top rail of a first door panel and a bottom rail of a neighboring door panel disposed above the first door panel, whereby the first panel and the second panel become flush and integrated.

4. The cabinet of to claim 2, wherein at a door-over-door orientation the locking member is removable upon displacing the door panels into an at least partially open position, accordingly, the locking cannot be removed at the closed position of the doors.

5. The door panel of claim 1, wherein the door reinforcing element is received at a cavity defined in the top rail and/or in the bottom rail of the door panel, said door reinforcing element comprises an integral locking eye, whereby in the absence of a locking member two neighboring doors are lockable one to the other through their respective integral locking eyes.

6. The door panel of claim 1, wherein one of the locking member and the door panel is configured with one or more protrusions, and the other of the locking member and the door panel is configured with respective snap indentions, for snapping retention of the locking member with the door panel.

7. The door panel of claim 1, wherein the door panel is made of plastic material, configured with cavities for receiving one or more door reinforcing elements comprising of a top rail, a bottom rail, a locking stile and a hinged stile, and wherein at least one of the door reinforcing elements is configured for receiving a locking eye.

8. The door panel of claim 1, wherein the locking member is configured for engaging two door-over-door panels of a cabinet, to thereby integrate said door panels, and wherein a locking member eye is configured for interaction in locking engagement with a neighboring locking member.

9. The door panel of claim 1, wherein the locking member is configured for sliding displacement within the recessed groove.

10. The door panel of claim 1, wherein the locking member is configured for snap-type articulation within the recessed groove.

11. The door panel of claim 1, wherein the locking member is configured with a gripping portion.

12. The door panel of claim 1, wherein the locking member is configured for articulating two or more door panels to one another, at a coplanar configuration, to thereby form an integrated, single door.

13. The door panel of claim 1, wherein the second leg portion of the locking member is configured with a locking eye.

* * * * *